United States Patent [19]

Bulson et al.

[11] Patent Number: 4,913,571

[45] Date of Patent: Apr. 3, 1990

[54] RE-INKING ROLLER AND TRANSFER ROLLER ASSEMBLY

[75] Inventors: Kevin F. Bulson, Charlotte, N.C.; Charles L. Decoste, Jr., Lexington; Jack W. Morris, Nicholasville, both of Ky.

[73] Assignee: International Business Machines Corporation, Armonk, N.Y.

[21] Appl. No.: 266,748

[22] Filed: Nov. 3, 1988

[51] Int. Cl.[4] ..... B41J 32/00

[52] U.S. Cl. ..... 400/196.1; 400/202.4; 400/208

[58] Field of Search ..... 400/202.4, 208, 196.1, 400/234

[56] References Cited

U.S. PATENT DOCUMENTS

| | | | |
|---|---|---|---|
| 4,091,914 | 5/1978 | Stipanuk | 400/202.4 X |
| 4,247,209 | 1/1981 | Carlson | 400/202.4 X |
| 4,449,838 | 5/1984 | Okamura | 400/202.4 X |
| 4,741,639 | 5/1988 | Fausto et al. | 400/196.1 |

FOREIGN PATENT DOCUMENTS

| | | | |
|---|---|---|---|
| 19649 | 10/1980 | European Pat. Off. | 400/202.4 |

*Primary Examiner*—Eugene H. Eickholt

*Attorney, Agent, or Firm*—John A. Brady

[57] ABSTRACT

Printer ribbon cartridge (1) has a re-inking roller (3) mounted on brackets (33, 35) of a mounting member (31). A leaf panel (45) biases the re-inking roller into transfer roller (5). To prevent failures resulting from permanent deformation of the re-inking roller which can occur during periods of non-use, the transfer roller is mounted on a shaft (9) which is smaller than the central hole (7) of the transfer roller. The printer ribbon (11) is positioned around the transfer roller where tension during normal ribbon feed will force the transfer roller firmly into the re-inking roller, where the ribbon is re-inked prior to entering the stuffed chamber (19) of the cartridge. During periods of non-use the transfer roller moves with respect to its shaft to relieve deformation pressure on the re-inking roller.

19 Claims, 3 Drawing Sheets

RE-INKING ROLLER AND TRANSFER ROLLER ASSEMBLY

Technical Field

This invention relates to re-inking by the adding of fluid ink to printer ribbons during normal use of the ribbon. Porous pads carrying ink to be added are now commonly available and have been incorporated in ribbon feed cartridges and other ribbon feed assemblies. This invention relates to the efficient and effective operation of such ribbon feed systems.

Background Art

Such porous re-inking pads in the form of a circular roller have been mounted in contact with a second, transfer roller. Both the re-inking roller and the transfer roller are mounted on central pivots for free rotation with their circumferences in contact. Motive power for the turning may be from the ribbon being re-inked, which typically is driven by the printer employing the roller.

In such an assembly the transfer roller must effectively engage the ribbon so as to be moved with it and must effectively engage the re-inking roller so as to move that roller during ribbon-feed operation. The transfer roller may be roughened or toothed so as to control the rate of ink transfer and to firmly engage both the ribbon and the transfer roller. The ink roller is biased firmly toward the transfer roller.

The re-inking roller is porous and therefore somewhat soft, and during periods of inactivity in such a system the re-inking roller tends to take a permanent offset, particularly at high ambient temperatures. This can result in total failure of the re-inking system since firm, effective contact between the transfer roller and the re-inking roller is necessary to rotate the re-inking roller.

U.S. Pat. No. 4,741,639 to Fausto et al shows such a system in a cartridge in which the transfer roller is mounted on a shaft with the shaft translatable within slots in the top and bottom walls of the cartridge. When ribbon tension relaxes, the transfer roller in this patent can move away from the re-inking roller.

Disclosure of Invention

In accordance with this invention the transfer roller is mounted for rotation on a shaft which is significantly smaller than the pivot hole of the transfer roller. The surface of the shaft opposite the re-inking roller is located to define a firm engagement between the transfer roller and the re-inking roller. The ribbon engages the outside of the transfer roller on the side of the transfer roller opposite the re-inking roller. The transfer roller is free to move relative to the pivot shaft when not under tension from the ribbon, and that movement relieves deformation forces on the re-inking roller during periods when the ribbon is not being fed.

When the ribbon is being fed, tension in the ribbon moves the transfer roller toward the re-inking roller, and operation is then much the same as for an assembly in which the transfer roller is mounted on a shaft which closely fits its pivot hole. Firm engagement between the ribbon and the transfer roller produces rotation of the transfer roller and firm engagement between the transfer roller and the re-inking roller produces rotation of the re-inking roller. The re-inking roller releases ink on to the transfer roller, and that ink is then absorbed by the ribbon where it contacts the transfer roller.

The hole-larger-than-pivot-shaft configuration in accordance with this invention involves few parts and no special guides for the transfer roller. The surface of the transfer roller shaft engaged by the transfer roller hole during ribbon feed preferably conforms at its outer surface with the arc of the transfer-roller-hole surface in which it fits, to thereby distribute forces.

Brief Description of the Drawing

The details of this invention will be described in connection with the accompanying drawing, in which.

Best Mode for CarrYing Out the Invention

Figure 1:
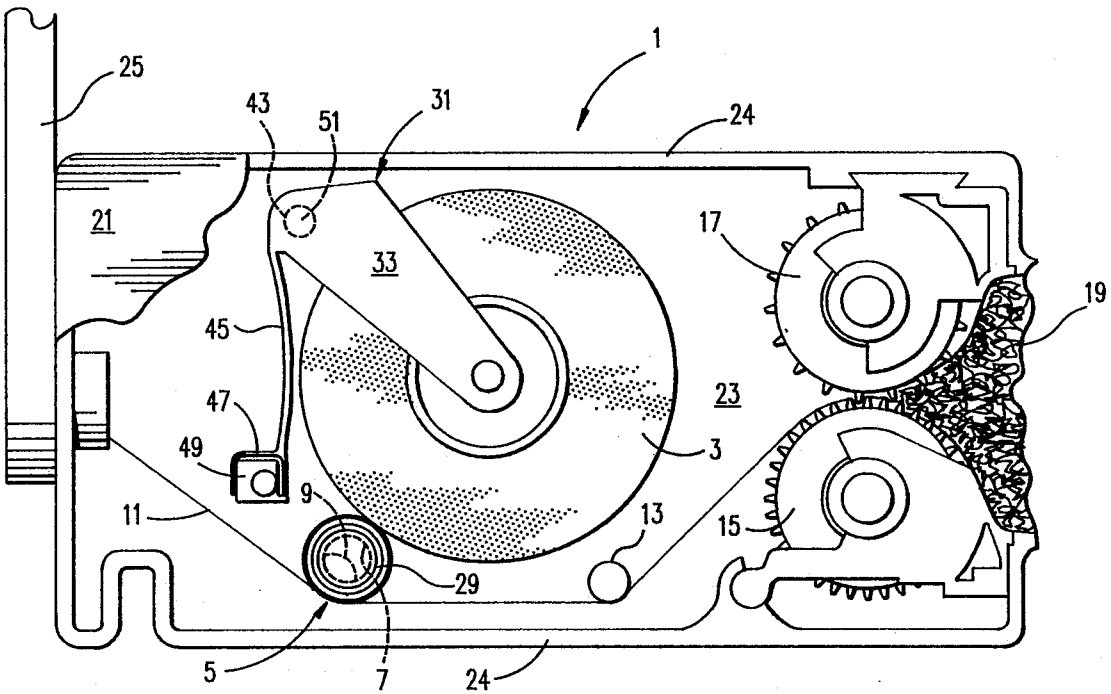
FIG. 1 is a plan view from the top of a part of a ribbon cartridge with the top cover largely removed.

FIG. 1 illustrates the part of a ribbon cartridge 1 containing a porous re-inking roller 3 and a transfer roller 5 having a central cylindrical hole 7 which receives bearing post or shaft 9. Ribbon 11 is positioned on the side of transfer roller 5 opposite re-inking roller 3, and extends to a guide roller 13, which guides ribbon 11 past re-inking roller 3, and ribbon 11 then extends to the nip of toothed feed rollers 15 and 17. Ribbon 11 is then stuffed in a zig-zag configuration, as is standard, in chamber 19, which is an additional part of cartridge 1. Ribbon 11 is a woven fabric ribbon soaked with a liquid ink, as is standard. Except for the re-inking system comprised primarily of rollers 3 and 5, the cartridge in overall configuration and in physical operation as a stuffed chamber cartridge is essentially identical to the cartridge sold for more than a year by the assignee of this invention as the ribbon supply for the IBM 4234 printer. Accordingly, aspects of the cartridge 1 not directly related to the re-inking assembly of this invention will not be discussed in detail.

Cartridge 1 has a top cover 21, which is shown largely broken away in FIG. 1 so as to illustrate the inside. Cartridge 1 is substantially closed, having and a bottom cover 23 and side walls 24. On each side is a large, pivoted ribbon guide arm 25.

Re-inking roller 3 is a generally available, commercial product offered for re-inking applications like that of this embodiment. With additional references to FIG. 2, roller 3 has pores filled with ink and transfers ink, apparently by capillary action, under moderate pressure to thereby coat the ends of teeth 27 on the transfer roller 5 with ink. The pore structure of roller 3 is adjusted by the commercial seller so as to conform to the ink-receiving characteristics of the ribbon 11. When roller 3 is deformed in one position for some time, particularly at temperatures above 120 degrees F (approximately 49 degrees C), roller 3 tends to remain in the deformed configuration, which causes potential failure of movement of roller 3. This potential failure is overcome in accordance with this invention.

Transfer roller 5 is made of a hard, acetal plastic and has a ring of elongated teeth 27 (FIG. 2) in its central region where it engages re-inking roller 3 and ribbon 11. Central hole 7 is cylindrical and extends from the bottom of roller 5 to near its top. Bearing shaft 9 is molded as an extension of bottom cover 23 and fits within and is substantially coextensive in length with hole 7. Shaft 9 is smaller in cross section than the diameter of hole 7, with its side away from roller 3 located to position transfer roller 5 in firm engagement with roller 3 when ribbon-feed tension on ribbon 11 forces roller 5 toward roller 3. The side of shaft 9 away from roller 3 has a curvature generally the same as that of the cross section of hole 7, thereby distributing forces during ribbon feed by contacting much of the surface of hole 7 during ribbon feed.

Figure 2:
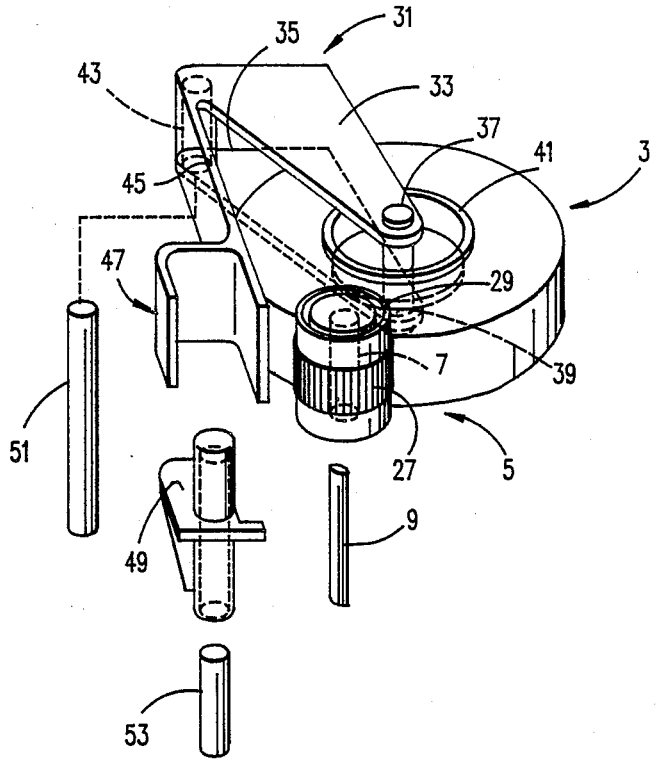
FIG. 2 is an exploded, perspective view of the re-inking roller, the transfer roller, and their mounting members.

In addition to hole 7, which is closed on the top as shown in FIG. 2, transfer roller 5 has a circular recessed region 29, which facilitates injection molding. Guide roller 13 is also of hard, acetal resin to withstand the abrasive forces from constant rubbing during use by ribbon 11.

Porous roller 3 is mounted biased toward roller 5 by a single mounting member 31. Member 31 includes bracket arm 33 and lower bracket arm 35, which are opposite one another and have holes receiving upper pivot stud 37 and a lower pivot stud 39 integral with a solid core member 41 of roller 3. Mounting member 31 has mounting opening 43 at the junction of bracket arms 33 and 35 and an elongate panel or leaf 45 integral with that junction. Panel 45 is at approximately a 45 degree angle to bracket arms 33 and 35 (this acute angle permits a structure which fits well in the rectangular space provided in the cartridge). Panel 45 is terminated by a three-sided, open-box configuration 47, which fits around generally square positioning member 49.

In cartridge 1, mounting member 31 has opening 43 mounted on a closely fitting post 51 which is integral with cartridge bottom cover 23. Positioning member 49 is also mounted somewhat above bottom cover 23 on a post 53 which is integral with bottom cover 23, to thereby block panel 45 from rotating. Bracket 35 supports core 41 to suspend roller 3 below top cover 21 and above bottom cover 23. Roller 3 is held by brackets 33 and 35 to freely rotate on pivot studs 37 and 39 respectively.

Member 31 is molded from a strong, resilient material, specifically, polycarbonate. When transfer roller 5 is not under tension, leaf panel 45 is positioned to be substantially straight and therefore relaxed, as shown in FIG. 2. During normal ribbon feed, nip roller 17 is driven in a conventional manner, and nip roller 15 is driven by roller 17. This applies sufficient tension to ribbon 11 to translate roller 5 within hole 7 toward roller 3 by repositioning hole 7 with respect to shaft 9, thereby applying pressure to re-inking roller 3. This pressure deforms roller 3 sufficiently to assure turning of roller 3 with roller 5 and to contact roller 3 sufficiently to release ink on to roller 5 as it turns. This pressure also bends leaf panel 45 into a bowed position, shown somewhat exaggerated in FIG. 1, which functions as a leaf spring to hold roller 3 firmly against roller 5.

Operation of this re-inking system during feed of ribbon 11 is entirely automatic. Transfer roller 5 is firmly pressed against ribbon 11, and roller 5 is therefore rotated by he feed movement of ribbon 11. Transfer roller 5 carries on its surface liquid ink which is automatically taken-up by ribbon 11 during contact with roller 5 to replace ink which has been used during printing. The ink in ribbon 11 is continuously replenished by ink expressed from roller 3 on to roller 5 during contact. Effective useful life of ribbon 11 is thereby extended until depletion of ink from roller 3.

Figure 3:
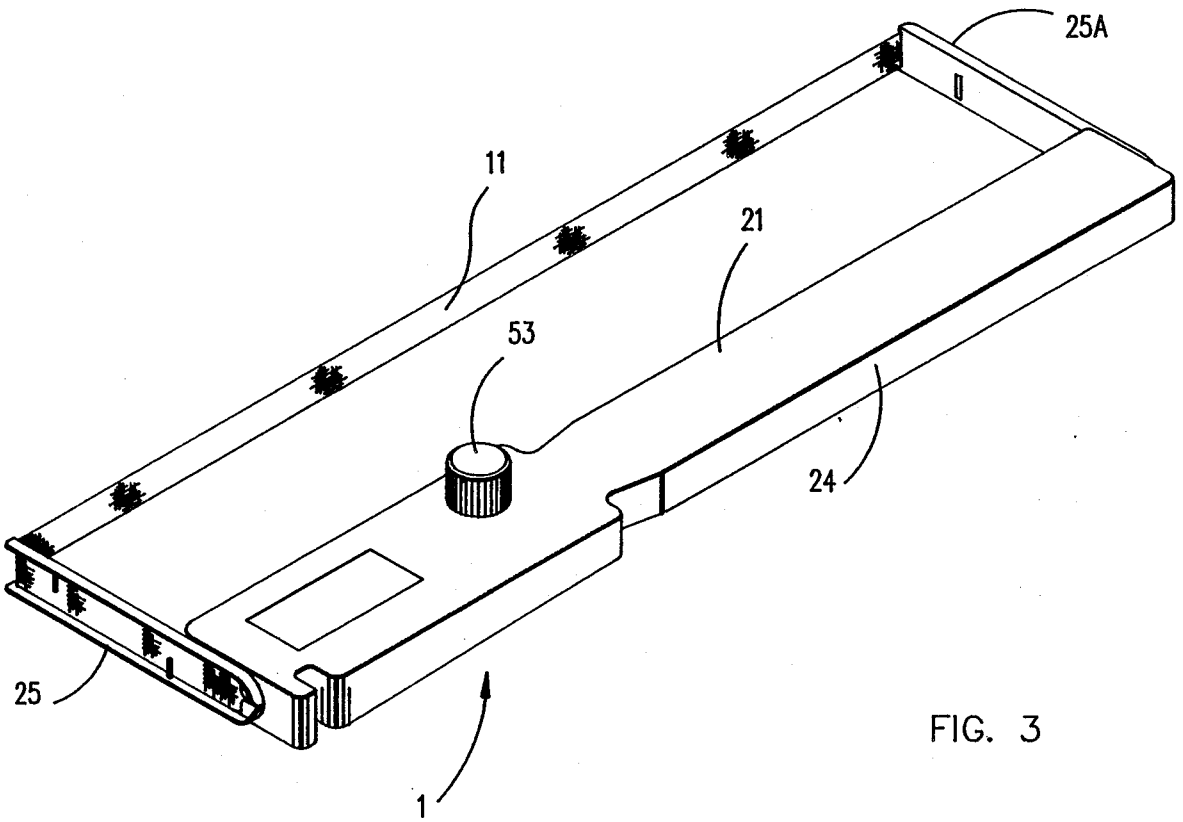
FIG. 3 illustrates the entire cartridge with full covers.

After re-inking at transfer roller 5, ribbon 11 is stuffed into chamber 19 (FIG. 1), where a very large proportion of ribbon 11 is held. Ribbon 11 is fed as a single strand from the side of chamber 19 to a guide arm 25A (FIG. 3), where it is positioned external of the cartridge for printing to occur, as is conventional. Ribbon 11 then re-enters cartridge 1, through guide arm 25, which is opposite guide arm 25A, where ribbon 11 is re-inked as previously described and then again stuffed into chamber 19. Ribbon 11 is continuous so that such ribbon movement can be continued indefinitely. Cartridge 1 has an external knob 53, fixed to nip roll 17, for occasional manual advancing or tightening of ribbon 11.

During periods of storage or non-printing for ribbon 11, tension on ribbon 11 is relaxed and the biasing force of leaf panel 45 moves roller 5 (by changing the position of hole 7 with respect to shaft 9) to a position at which panel 45 is generally straight and relaxed. Roller 3 is then not significantly deformed by contact with roller 5, and the tendency of roller 3 to permanently deform when held in a deformed position for an extended period, particularly at high temperatures, is not a factor. Therefore, when feed of ribbon 11 is subsequently begun, roller 5 is pressed into firm contact with roller 3, and reliable operation is experienced.

The term "printer" is a generic term which encompasses typewriters and any use of "printer" in this description is intended to be so understood. Various modifications of this assembly will be apparent, and other modifications within the spirit and scope of this invention may be devised. Accordingly, patent coverage should be as provided by law, with particular reference to the accompanying claims.

We claim:

1. A printer ribbon feed assembly comprising means to feed said ribbon for printing, a porous re-inking roller mounted for rotation, a transfer roller mounted for rotation by a central wall defining a smooth, non-wearing hold in said transfer roller central to said transfer roller and a shaft, said shaft being fixed in position relative to the position of said central hole, said transfer roller receiving said fixed shaft in said central hole and being limited in movement radial to said shaft by contact between said central hole and said shaft, said central hole being larger than said shaft and said shaft and said central hole being in locations which position said transfer roller in firm contact with said re-inking roller when said central hole contacts said shaft on the side of said shaft away from said re-inking roller and which permit movement of said transfer roller away from a firm contact with said re-inking roller, and a printer ribbon to be re-inked mounted in contact with the side of said transfer roller away from said re-inking roller so that feeding of said ribbon for printing will rotate said transfer roller and move said transfer roller into contact with said re-inking roller to rotate said re-inking roller while releasing ink from said re-inking roller to re-ink said ribbon.

2. The ribbon feed assembly as in claim 1 in which said re-inking roller is resiliently biased toward said transfer roller.

3. The ribbon feed assembly as in claim 2 in which said re-inking roller is mounted by a member having a bracket holding said re-inking roller rotatably and having a resilient panel integral with said bracket functional as a leaf spring.

4. The ribbon feed assembly as in claim 3 in which said bracket and said panel are positioned at an acute angle from one another and said panel member is blocked from rotation.

5. The ribbon feed assembly as in claim 4 in which the surface of said shaft which contacts the surface of said hole on their sides away from said re-inking roller have conforming arcs to thereby distribute forces.

6. The ribbon feed assembly as in claim 1 in which the surface of said shaft which contacts the surface of said hole on their sides away from said re-inking roller have conforming arcs to thereby distribute forces.

7. The ribbon feed assembly as in claim 2 in which the surface of said shaft which contacts the surface of said hole on their sides away from said re-inking roller have conforming arcs to thereby distribute forces.

8. A cartridge containing a continuous printer ribbon which exits said cartridge for printing and then is returned to said cartridge comprising means to feed said ribbon for printing, a porous re-inking roller mounted for rotation, a transfer roller mounted for rotation by a central wall defining a smooth, non-wearing hole in said transfer roller central to said transfer roller and a shaft, said shaft being fixed in position relative to the position of said central hole, said transfer roller receiving said fixed shaft in said central hole and being limited in movement radial to said shaft by contact between said central hole and said shaft, said central hole being larger than said shaft and said shaft and said central hole being in locations which position said transfer roller in firm contact with said re-inking roller when said central hole contacts said shaft on the side of said shaft away from said re-inking roller and which permit movement of said transfer roller away from a firm contact with said re-inking roller, said ribbon being mounted in contact with the side of said transfer roller away from said re-inking roller so that feeding of said ribbon for printing will rotate said transfer roller and move said transfer roller into contact with said re-inking roller to rotate said re-inking roller while releasing ink from said re-inking roller to re-ink said ribbon, and a chamber into which said ribbon is stuffed after contact with said transfer roller and before exit of said ribbon from said chamber for printing.

9. The ribbon cartridge of claim 8 in which said re-inking roller is resiliently biased toward said transfer roller.

10. The ribbon cartridge as in claim 9 in which said re-inking roller is mounted by a member having a bracket holding said re-inking roller rotatably and having a resilient panel integral with said bracket functional as a leaf spring.

11. The ribbon cartridge as in claim 10 in which said bracket and said panel are positioned at an acute angle from one another and said panel member is blocked from rotation.

12. The ribbon cartridge as in claim 11 in which the surface of said shaft which contacts the surface of said hole on their sides away from said re-inking roller have conforming arcs to thereby distribute forces.

13. The ribbon cartridge as in claim 8 in which the surface of said shaft which contacts the surface of said hole on their sides away from said re-inking roller have conforming arcs to thereby distribute forces.

14. The ribbon cartridge as in claim 9 in which the surface of said shaft which contacts the surface of said hole on their sides away from said re-inking roller have conforming arcs to thereby distribute forces.

15. The ribbon cartridge as in claim 10 in which the surface of said shaft which contacts the surface of said hole on their sides away from said re-inking roller have conforming arcs to thereby distribute forces.

16. The ribbon cartridge as in claim 15 in which said mounting member having a bracket and a panel is mounted on a shaft integral with the bottom of said cartridge.

17. The ribbon cartridge as in claim 10 in which said mounting member having a bracket and a panel is mounted on a shaft integral with the bottom of said cartridge.

18. The ribbon cartridge as in claim 11 in which said mounting member having a bracket and a panel is mounted on a shaft integral with the bottom of said cartridge.

19. The ribbon cartridge as in claim 12 in which said mounting member having a bracket and a panel is mounted on a shaft integral with the bottom of said cartridge.

* * * * *